US006393240B1

(12) United States Patent
Seto

(10) Patent No.: US 6,393,240 B1
(45) Date of Patent: May 21, 2002

(54) WET IMAGE FORMING APPARATUS WITH IMPROVED DEVELOPER IMAGE

(75) Inventor: Shoko Seto, Kawasaki (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/662,816

(22) Filed: Sep. 15, 2000

(51) Int. Cl.[7] ..... G03G 15/10
(52) U.S. Cl. ..... 399/249; 15/256.51
(58) Field of Search ..... 15/256.51; 399/237, 399/249, 348, 352

(56) References Cited

U.S. PATENT DOCUMENTS 5,758,236 A * 5/1998 Teschendorf et al. ..... 399/249
6,104,901 A * 8/2000 Imamiya ..... 399/249

* cited by examiner

*Primary Examiner*—Sophia S. Chen
*Assistant Examiner*—Hoang Ngo
(74) *Attorney, Agent, or Firm*—Foley & Lardner

(57) ABSTRACT

An image forming apparatus includes an exposure unit for forming a latent image on a photosensitive body which is rotating, a developing device, containing liquid developer in which developer particles are dispersed in a solvent, for supplying the liquid developer to the latent image on the photosensitive body and forming a developer image, a squeeze roller, which rotates in contact with the photosensitive body, for removing a surplus of the liquid developer remaining on the photosensitive body after development; and a transfer unit for transferring the developer image to a paper sheet after the surplus of the liquid developer is removed by the squeeze roller. The squeeze roller has a surface configuration which allows contact with the developer image on the photosensitive body with a uniform contact pressure in a contact portion where the squeeze roller contacts to the photosensitive body.

10 Claims, 5 Drawing Sheets

実施例

比較例

WET IMAGE FORMING APPARATUS WITH IMPROVED DEVELOPER IMAGE

BACKGROUND OF THE INVENTION

The present invention relates to a wet image forming apparatus applicable as an electrophotographic copying machine or a laser beam printer and using a developing solution in which toner is dispersed in a solvent.

A liquid developer used in this type of wet image forming apparatus mainly comprises a petroleum nonpolar solvent and toner particles made of resin and pigment dispersed in the solvent. A charge assisting agent is added to the solvent liquid, and the toner is charged at a predetermined potential by means of the charge assisting agent.

Since the toner particles used in the wet image forming apparatus have smaller diameters as compared to those used in a dry image forming apparatus, the image quality can be improved. In addition, since the resin content of the toner is low, less energy is required for fixation. For these reasons, the wet image forming apparatus has lately attracted considerable attention.

Incidentally, after development, the surplus developer which remains on a photosensitive body is lightly squeezed. After the squeeze, a toner image is sent to a transfer region, and transferred to a paper sheet by an electric field transfer method. In other words, an electric field is applied to the photosensitive body in the toner image transfer process, with the result that the toner is electrically migrated and transferred to the paper sheet.

The electric field transfer method has problems that a toner image is liable to be disturbed in the transfer process, and that the surplus solvent is transferred to the paper sheet and cannot be fully collected.

To solve the problems, an offset transfer method has been developed, in which a toner image is transferred by means of either heat or pressure or both heat and pressure in the transfer process without using cataphoresis.

According to the offset transfer method, since the toner image is completely dried before transfer, it is not disturbed in the transfer process. In addition, since the solvent, which is stinking and flammable, can be collected in an early part of the image forming process, the method is advantageous over the electric field transfer method.

In the offset transfer method, it is necessary to completely dry the toner image on the photosensitive drum during a period between development and transfer. For this purpose, generally, a squeeze roller is used together with a drying blower.

The squeeze roller is formed by, for example, die-moldering conductive polyurethane resin.

However, conventionally, when the surface configuration of the squeeze roller is determined, the relationship with the toner image formed on the photosensitive body or the relationship with the width of a portion where the squeeze roller contacts to the photosensitive body was not taken into consideration at all. Therefore, when the surplus developer is squeezed, an asperity pattern on the surface of the squeeze roller is stamped on the toner layer formed on the photosensitive drum. As a result, the quality of the toner image transferred from the photosensitive body to the paper sheet is lowered.

BRIEF SUMMARY OF THE INVENTION

The present invention was made in consideration of the above matters. Accordingly, an object of the present invention is to provide a wet image forming apparatus, in which the surface of removing means has such a configuration as to be in contact with a developer image formed on an image carrier body with a uniform contact pressure and the height of a surface asperity of the removing means is lower than the thickness of the layer of the developer image on the image carrier body, so that the developer image formed on the image carrier body is prevented from disturbance when a surplus developer liquid is removed by the removing means.

An image forming apparatus of the present invention comprises: image forming means for forming a latent image on an image carrier body which is rotating; developing means, containing liquid developer in which developer particles are dispersed in a solvent, for supplying the liquid developer to the latent image on the image carrier body and forming a developer image; removing means, which rotates in contact with the image carrier body, for removing a surplus of the liquid developer remaining on the image carrier body after development; and transfer means for transferring the developer image to a transfer material after the surplus of the liquid developer is removed by the removing means, the removing means having a surface configuration which allows contact with the developer image on the image carrier body with a uniform contact pressure in a contact portion where the removing means contacts to the image carrier body.

An image forming apparatus of the present invention comprises: image forming means for forming a latent image on an image carrier body which is rotating; developing means, containing liquid developer in which developer particles are dispersed in a solvent, for supplying the liquid developer to the latent image on the image carrier body and forming a developer image; removing means, which rotates in contact with the image carrier body, for removing a surplus of the liquid developer remaining on the image carrier body after development; and transfer means for transferring the developer image to a transfer material after the surplus of the liquid developer is removed by the removing means, the removing means having surface roughness smaller than a thickness of a layer of the developer image formed on the image carrier body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be described below in detail with reference to the drawings.

Figure 1:
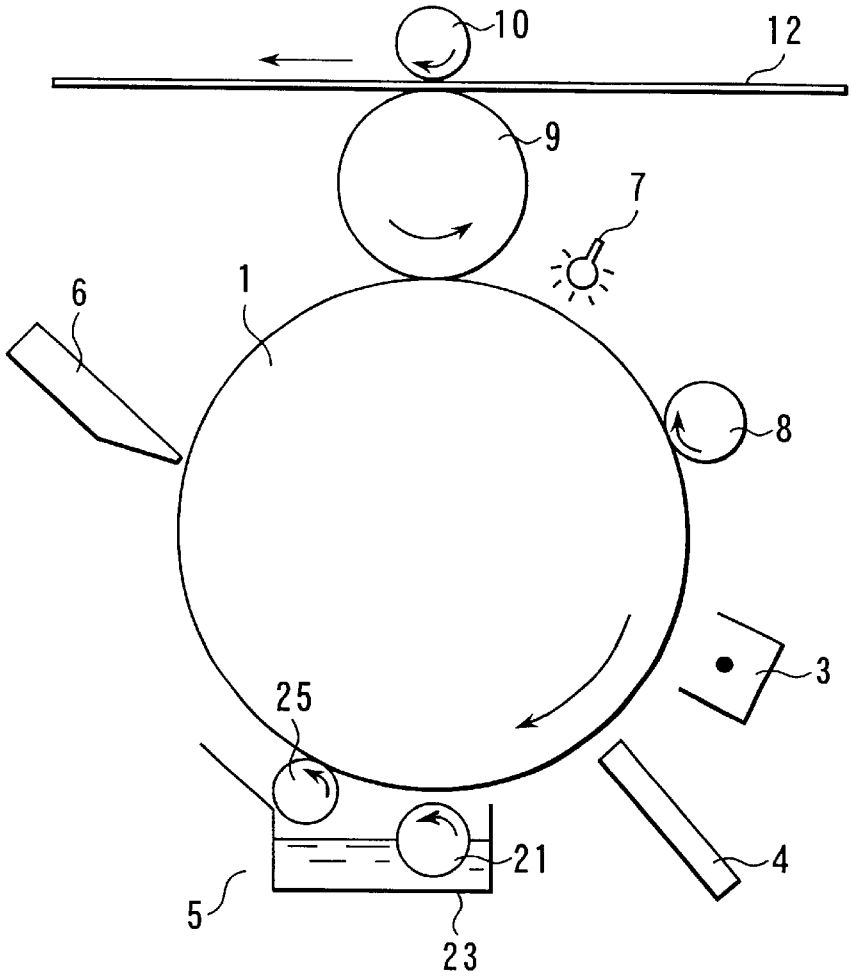
FIG. 1 is a schematic structural diagram showing a wet image forming apparatus according to a first embodiment of the present invention.

FIG. 1 is a schematic structural diagram showing a wet image forming apparatus, a wet electrophotographic apparatus, according to an embodiment of the present invention.

In the drawing, a reference numeral 1 denotes a photosensitive body serving as an image carrier body. The photosensitive body comprises a base material made of circular aluminum or sheet-like aluminum and a photosemiconductor layer of a predetermined thickness formed on the base material. The surface of the photosensitive body 1 is uniformly charged at, for example, 600 V, by a charging roller or charger 3. The photosensitive body 1 is rotated at a predetermined rotation speed by a drum motor (not shown).

Light corresponding to image information to be output is radiated on the surface of the photosensitive body 1 charged at a predetermined potential by means of a known exposure device 4, such as a laser beam exposure device or a line LED. As a result, a latent image corresponding to the image information is formed.

A developing device 5 has a developing roller 21 which faces the outer circumferential surf ace of the photosensitive body 1 with a space of about 40 to 300 $\mu$m therebetween. The developing device 5 selectively supplies toner, serving as a developer, to the latent image formed on the photosensitive body 1. The developing roller 21 is rotated at a predetermined rotation rate by means of a developing motor, or a drum motor for rotating the photosensitive body 1 and a rotation transmitting mechanism (not shown). The developing device 5 is a wet developing device using developer liquid prepared by dispersing toner and a charge assisting agent in a solvent.

A drying blower 6, for drying the toner liquid (developer liquid) and remainder solvent of the toner supplied to the photosensitive body 1 by the developer device 5, is mounted on the downstream side of the developer device 5 along the direction of rotation of the photosensitive body 1.

An intermediate transfer body 9, for temporarily holding a toner (image) in the form of a mirror image, is mounted on the downstream side of the blower 6 along the direction of rotation of the photosensitive body 1. The intermediate transfer body 9 transfers the toner (image) formed on the photosensitive body 1 to an output transfer medium, for example, a transfer paper sheet. The intermediate transfer body 9 is rotated at a predetermined rotation speed by means of a developing motor, or a drum motor for rotating the photosensitive body 1 and a rotation transmitting mechanism (not shown).

A backup roller 10 is pressed against an upper side of the intermediate transfer body 9. The backup roller 10 is pressed with a predetermined pressure against the periphery of the intermediate transfer body 9, with the result that it is rotated in a direction of the arrow at a speed equal to the speed of movement of the periphery of the intermediate transfer body 9.

A static eliminator 7, for eliminating a potential remaining on the photosensitive body 1 and a charge carried by the toner adhered to the photosensitive body 1 by electrostatic force, and a cleaner 8, for cleaning the toner remaining on the photosensitive body 1, are located at predetermined positions downstream of the intermediate transfer body 9 along the direction of rotation of the photosensitive body 1.

In the image forming apparatus as described above, the photosensitive body 1 charged to the predetermined potential by the charger 3 is exposed to image information corresponding to an image to be output from the exposure device 4 as the variations of light and shade. As a result, an electrostatic latent image is formed on the photosensitive body 1. Toner is selectively supplied to the electrostatic latent image formed on the photosensitive body 1 in a development position where the developing device 5 and the photosensitive body 1 face each other. As a result, the electrostatic latent image is developed and visualized. The solvent component of the toner supplied to the photosensitive body 1 in the developing step is removed by the blower 6. Then, the toner is transferred to the peripheral surface of the intermediate transfer body 9 in a transfer position facing the intermediate transfer body 9. In a transfer region where the backup roller 10 is in contact with the intermediate transfer body 9, the toner (image) which have been transferred to the peripheral surface of the intermediate transfer body 9 is transferred to an outputting transfer material 12 supplied from a transfer material holding section 11 typified by a paper sheet cassette.

The toner (image) transferred to the transfer material 12 is fixed thereto by a fixing device (not shown) by heating the toner and the transfer material to melt the toner, and applying a pressure thereto. Then, the transfer material 12 is carried to a predetermined position. When the toner (image) is transferred to the outputting transfer material, the toner (image) is fixed to the transfer material relatively firmly. Therefore, the fixing device may be omitted. Alternatively, heat and pressure may be applied in the transfer region, so that the transfer region may also serve as a fixing device. After the toner image is transferred, the potential remaining on the photosensitive body 1 and the charge carried by the toner adhered to the photosensitive body 1 by electrostatic force are eliminated by the static eliminator 7. After the elimination, the toner remaining on the photosensitive body 1 is removed by the cleaner 8.

The developing roller 21 of the developing device is arranged to face the photosensitive body 1 with a distance of 40 to 300 μm from the peripheral surface of the photosensitive body 1. The developing roller 21 is rotated such that the peripheral surface thereof is moved at a speed 0.2 to 4 times that of the movement of the peripheral surface of the photosensitive body 1 in the same direction as that of the rotation of the photosensitive body 1. Further, a developing bias voltage of 100 to 600 V is applied to the surface of the developing roller 21 by a power source.

The developing roller 21 is housed in a housing 23. The housing 23 contains, at a predetermined position, a squeeze roller 25 serving as removing means for squeezing the developer liquid supplied by the developing roller 21 to the photosensitive body 1 along the direction of rotation of the photosensitive body 1.

Figure 2:
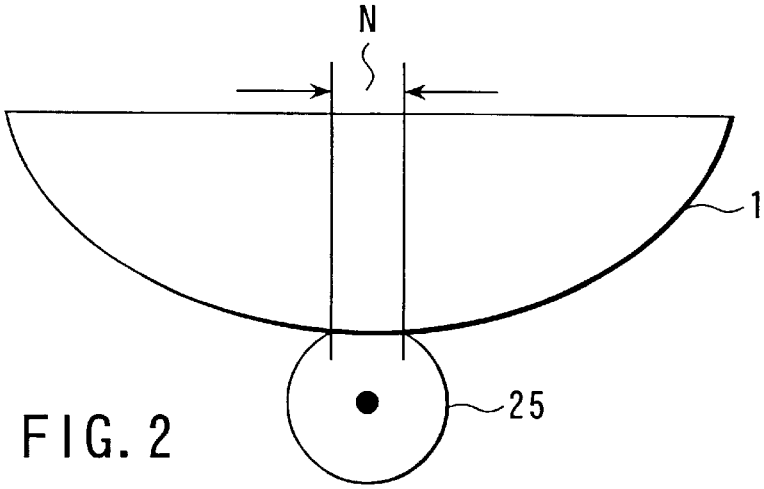
FIG. 2 is a schematic structural diagram showing a squeeze roller in contact with the photosensitive body.

The squeeze roller 25, made of conductive and elastic material, is brought into contact with the peripheral surface of the photosensitive body 1 with a predetermined pressure so as to have a predetermined nip width, for example, as shown in FIG. 2. As a result, the squeeze roller 25 is driven in accordance with the photosensitive body 1, and rotated at a speed equal to the speed of movement of the periphery of the photosensitive body 1. A voltage of, for example, 400 to 800 V, is applied to the squeeze roller 25 by a power source (not shown). The nip width represents the length of that portion of the peripheral surface of the squeeze roller 25, having elasticity, which is deformed as a result of the contact with the photosensitive body 1.

The liquid developer is prepared by dispersing toner, made of resin and pigment, and a charge assisting agent in a petroleum solvent. In this embodiment, the toner is positively charged by the charge assisting agent. The toner may be charged either positively or negatively. In general, it is charged to a polarity determined by the charge characteristic of the photosemiconductor of the photosensitive body 1 and the exposure method.

A developing operation of the developing device 5 will now be described in detail.

In the developing device 5, the developer liquid, in which the toner and the charge assisting agent are dispersed in the solvent, is supplied by the rotation of the developing roller 21 to the gap at the development position where the developing roller 21 and the photosensitive body 1 face each other. The toner in the developer liquid (toner liquid) selectively adheres to the latent image by an electrical field formed by the charge potential applied to the photosensitive body 1 (the surface potential of the photosensitive body 1) and the developing bias voltage, so that the latent image is developed. At this time, the toner on a non-image portion adheres to the surface of the developing roller 21 upon reception of the force of an electrical field in a direction opposite to that of the latent image portion of the photosensitive body 1.

The toner on the non-image portion adhered to the developing roller 21 is conveyed within the housing 23 in accordance with the rotation of the developing roller 21. Then, it is scraped off by a developer liquid scraping blade or a cleaning roller (not shown), and circulated within the housing 23. As a result, a constant amount of toner liquid in a constant toner concentration in the solvent is always circulated in the development position where the developing roller 21 and the photosensitive body 1 face.

After the development described above, as the photosensitive body 1 rotates, the toner image is conveyed to a nip region where the squeeze roller 5 and the photosensitive body 1 are in contact. The squeeze roller 25 contacts to the peripheral surface of the photosensitive body 1 with a predetermined pressure, so that it squeezes the surplus solvent remaining on the non-image portion of the peripheral surface of the photosensitive body.

As a result, the solvent remaining on the peripheral surface of the photosensitive body 1 passed through the nip region, where the squeeze roller 25 contacts to the photosensitive body 1, is considerably reduced.

The surface configuration of the squeeze roller 25 will be described in detail.

Figure 3:
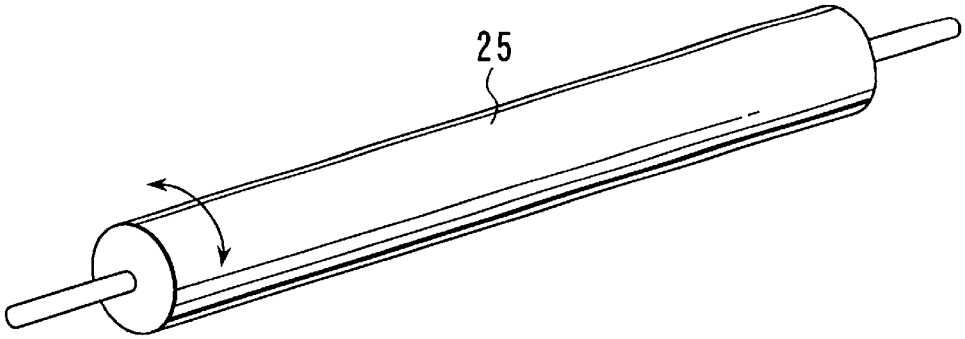
FIG. 3 is a perspective view showing the squeeze roller shown in FIG. 2.
Figure 4:
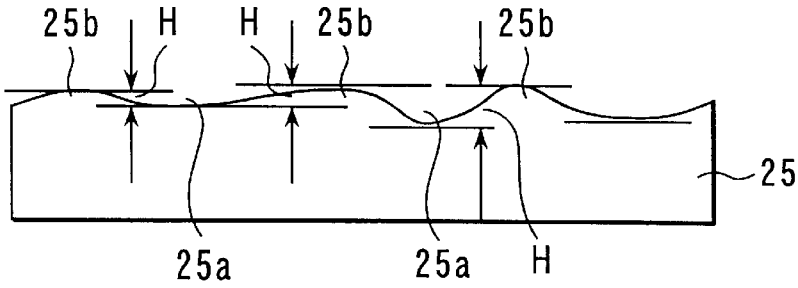
FIG. 4 is a cross-sectional view showing surface roughness of the squeeze roller shown in FIG. 2.
Figure 5:
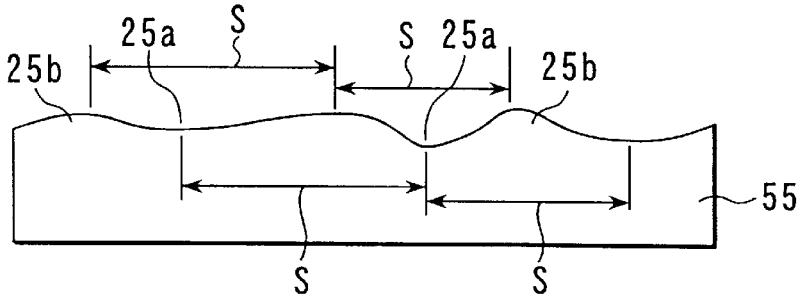
FIG. 5 is a cross-sectional view showing periods of concavities and convexities on the surface of the squeeze roller shown in FIG. 2.

FIG. 3 is a perspective view showing the squeeze roller 25. On the surface of the squeeze roller 25, concavities 25*a* and convexities 25*b* are continuously formed along the direction of rotation of the roller, as shown in FIGS. 4 and 5. Surface roughness H of the squeeze roller 25 corresponds to a difference in height between the adjacent concavity and convexity 25*a* and 25*b*.

A period S of the concavities and convexities 25*a* and 25*b* of the squeeze roller 25 corresponds to a distance between the crests of the adjacent convexities 25*b* or the troughs of the adjacent concavities 25*a*.

Figure 6:
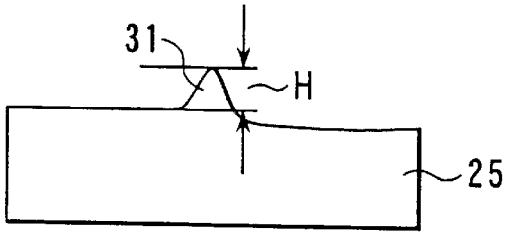
FIG. 6 is a cross-sectional view showing roughness of a surface convexity of the squeeze roller shown in FIG. 2.
Figure 7:
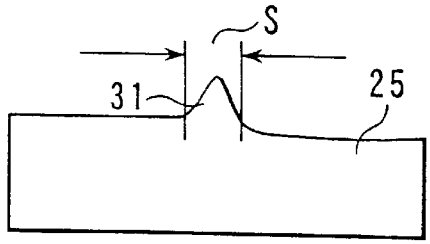
FIG. 7 is a cross-sectional view showing a period of a convexity on the surface of the squeeze roller shown in FIG. 2.
Figure 8:
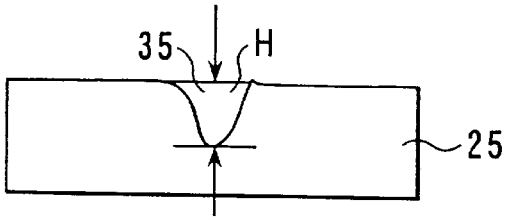
FIG. 8 is a cross-sectional view showing roughness of a surface concavity of the squeeze roller shown in FIG. 2.
Figure 9:
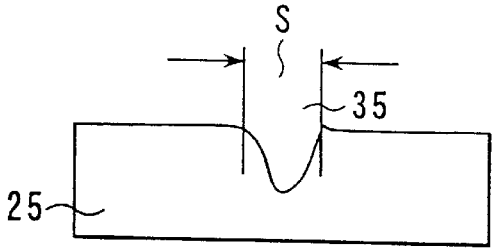
FIG. 9 is a cross-sectional view showing a period of a concavity on the surface of the squeeze roller shown in FIG. 2.

The concavities and convexities 25*a* and 25*b* are not necessarily formed continuously on the squeeze roller 25. A convexity 31 may be formed in isolation, as shown in FIGS. 6 and 7, or a concavity 35 may be formed in isolation, as shown in FIGS. 8 and 9. In this case, the surface roughness H of the squeeze roller 25 corresponds to the height of the convexity 31 or the depth of the concavity 35, and the period S corresponds to the width of the bottom of the convexity 31 or the width of the upper surface portion of the concavity 35.

The surface roughness H of the squeeze roller 25 and the period S of the concavities and convexities are measured two-dimensionally by a Contact surface roughness tester (Surfcorder SE-40D by Kosaka Laboratory Ltd.), or three-dimensionally by a contact surface roughness measuring mode of a laser microscope (Lasertec Laser microscope 1LM21).

Concrete embodiments of the squeeze roller 25 will be described below.

First, a first embodiment of the squeeze roller 25 will be described.

According to the first embodiment, conductive polyurethane resin having a resistance of $10^8$ Ωcm was injected into a mold, so that the squeeze roller 25 was molded. After the molding, the surface of the squeeze roller 25 was polished to smooth the roughness of the surface. After the polishing, a Teflon tube having a thickness of 100 μm and a flat surface was put on the squeeze roller 25 into intimate contact with the peripheral surface of the roller. The outermost diameter ϕ of the squeeze roller covered by the Teflon tube was 17 mm.

When variation in diameter of the squeeze roller 25, i.e., the distance between the center of the roller and the periphery, was measured along the circumferential direction, the average surface roughness H (JIS B0601) of ten points was 10 μm and the period S of the concavities and convexities was 50 to 200 μm.

The squeeze roller 25 was loaded into an exposure and development process, in which a minimum dot diameter is adjusted to 30 μm by means of an optical system of 600 dpi having a reduced laser spot diameter of 70 μm.

In the exposure and development process, a bias of 800 V was applied to the shaft of the squeeze roller 25. The squeeze roller 25 was pressed against and followed the photosensitive body 1 such that the contact nip width was 1 mm, to form an image thereon.

According to the first embodiment, the period S of the concavities and convexities of the surface of the squeeze roller (50 to 200 μm) is greater than the minimum dot diameter or the width of the thinnest line (30 μm) as the smallest constitutional unit of a developed toner image. Therefore, even if an imbalance in contact pressure is created in the nip portion, the pressure is distributed when the toner layer portion is observed locally. Consequently, since the toner layer is not disturbed, the image is not degraded.

In other words, according to the first embodiment, the image in a low concentration portion, constituted by minute dots, was not disturbed. The image was transferred and dried while dot configuration was maintained, with the result that a quality image was obtained.

A second embodiment of the squeeze roller 25 will now be described.

In the second embodiment, conductive polyurethane resin having a resistance of $10^{10}$ Ωcm is injected into a mold having a mirror-finished inner surface, so that the squeeze roller 25 having an outer diameter ϕ of 17 mm is molded. The average surface roughness H (JIS B0601) of ten points of the squeeze roller 25 was 30 μm and the period S of the concavities and convexities of the surface was about 600 μm.

The squeeze roller 25 was pressed against and followed the photosensitive body 1 such that the contact nip width was 0.5 mm, to form an image thereon.

According to the second embodiment, the period S of the concavities and convexities of the surface of the squeeze roller along the direction of rotation (600 μm) is greater than the contact nip width (0.5 mm). Therefore, an imbalance in contact pressure in the nip portion is distributed. Consequently, since the toner layer is not disturbed, the image is not degraded.

In other words, according to the second embodiment, a thin line or a minute dot was not omitted and the image in a solid portion was not disturbed. The image was transferred and dried while it was maintained, with the result that a quality image was obtained.

If the period S of the concavities and convexities of the surface of the squeeze roller along the direction of rotation is smaller than the contact nip width, the contact pressure in the nip portion is imbalanced and the toner layer is disturbed, resulting in degradation of the image.

A third embodiment of the squeeze roller 25 will be described.

Figure 10:
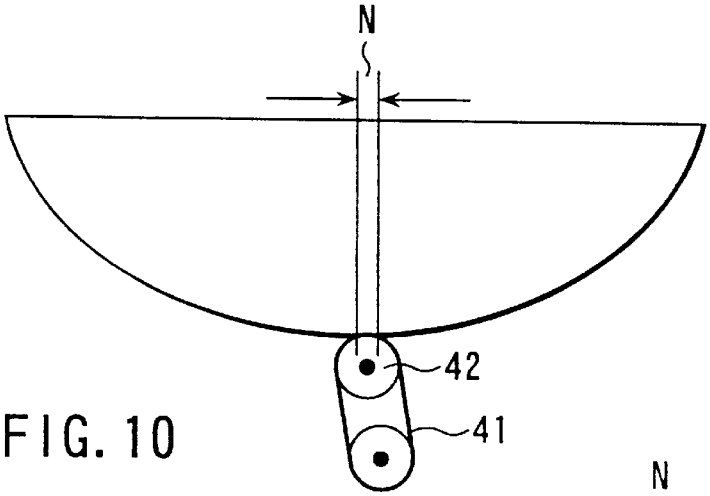
FIG. 10 is a diagram showing a first modification of removing means, i.e., a squeeze belt.

As shown in FIG. 10, according to the third embodiment, removing means is constituted by a seamless belt 41. The seamless belt 41 is made of conductive polyurethane resin having a resistance of $10^8$ Ωcm. It is 200 μm thick and the surface thereof is smoothed.

The average surface roughness H of ten points of the seamless belt 41 is 0.5 μm and the maximum height is 0.8 μm. The seamless belt 41 is pressed against the photosensitive body 1 by elastic rollers (ϕ17 mm) applied thereto from the inside, such that the contact nip is 1 mm, and rotated at the same speed as that of the photosensitive body 1.

The seamless belt 41 was loaded into an image forming process to from an image using a developing device for developing a latent image on the photosensitive body 1 by means of a liquid developer in which toner having a particle diameter of 1 μm is dispersed, and forming a toner layer of a thickness of 1.2 μm on the photosensitive body 1.

In the third embodiment, since the surface roughness H of the seamless belt (0.8 μm) is smaller than the thickness of the toner layer (1.2 μm), the convexities on the surface of the seamless belt 41 do not reach the surface of the photosensitive body 1. Therefore, the image is not degraded.

In other words, according to the third embodiment, toner images in minute dots, thin lines and solid portions were not disturbed. The image was transferred and dried while it was maintained, with the result that a quality image was obtained.

If the surface roughness of the seamless belt is greater than the thickness of the toner layer, a convexity will be engaged in the toner layer and reach the surface of the photosensitive body 1. In this case, the toner in the engaged portion is removed away to both sides thereof, resulting in disturbance of the image.

Figure 11:
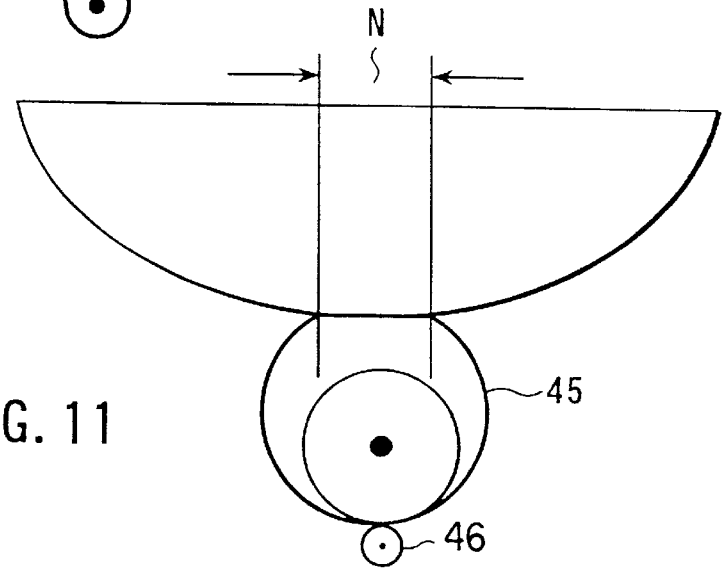
FIG. 11 is a diagram showing a second modification of removing means, i.e., a flexible tube.

If a flexible tube 45 a shown in FIG. 11 is used as a removing member, the same effect and advantage as those of the above embodiments can be obtained. A back up roller 46 is rotatably in contact with the flexible tube 45.

COMPARATIVE EXAMPLE

Conductive polyurethane resin having a resistance of $10^8$ Ωcm was injected into a mold to form a roller. After molding the roller, the surface thereof was polished to smooth the roughness or undulation of the surface formed during the molding in the mold. Thus, a contact squeeze roller having the outermost diameter ϕ of 17 mm was produced.

When variation in diameter of the contact squeeze roller, i.e., the distance between the center of the roller and the periphery, was measured with a laser displacement gage along the circumferential direction, the average surface roughness H (JIS B0601) of ten points was 18 μm and the period S of the concavities and convexities was 5 to 35 μm.

The contact squeeze roller 25 was loaded into an exposure and development process, in which a minimum dot diameter is adjusted to 30 μm by means of an optical system of 600 dpi having a reduced laser spot diameter of 70 μm. Then, a bias of 800 V was applied to the shaft of the contact squeeze roller, and the roller was pressed against and followed the photosensitive body 1 such that the contact nip width was 1 mm. In this case, image defects occurred, for example, minute dots were chipped or thin lines were broken.

Figure 13:
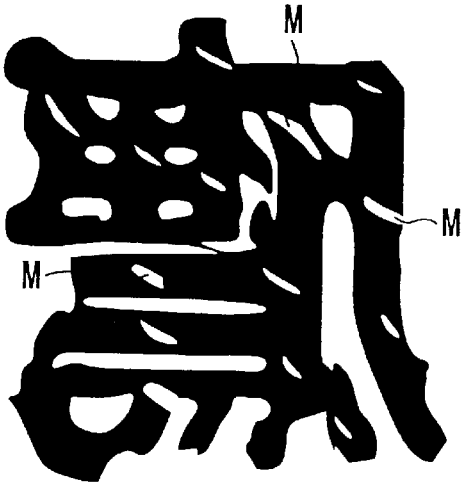
FIG. 13 is an image formed by a conventional apparatus.

Further, a solid image included patterns M having widths of 5 to 35 μm, as shown in FIG. 13, which appeared to result from the surface roughness of the contact squeeze roller. Clearly, the image obtained after the contact squeeze was deteriorated.

Figure 12:
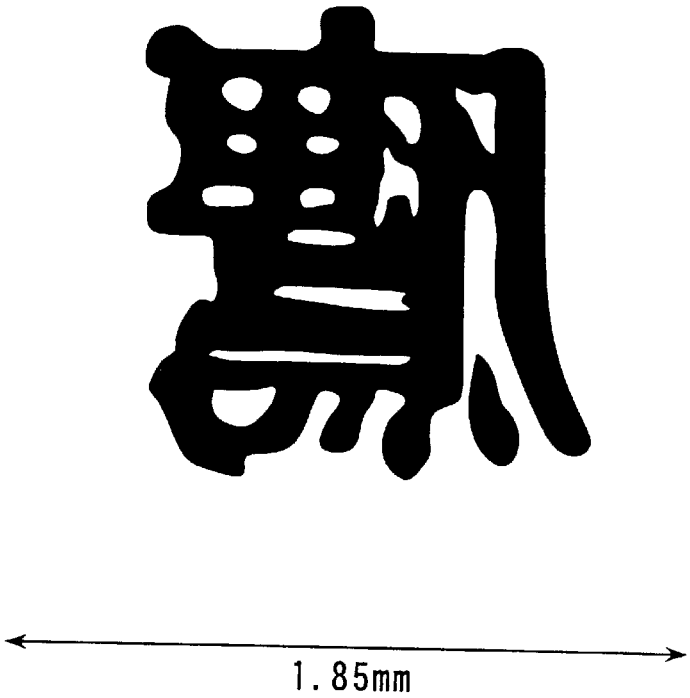
FIG. 12 is an image formed by the apparatus of the present invention.

FIG. 12 shows a solid image formed by the embodiment of the present invention. This is a quality image which does not include patterns M having widths of 5 to 35 μm as shown in FIG. 13, which may result from the surface roughness of the contact squeeze roller.

The above description concerns the image forming apparatus of the offset-offset transfer system using the intermediate transfer body 9 as shown in FIG. 1. However, an image forming apparatus of the direct offset system without an intermediate transfer body 9, as shown in FIG. 14, may be used.

Figure 14:
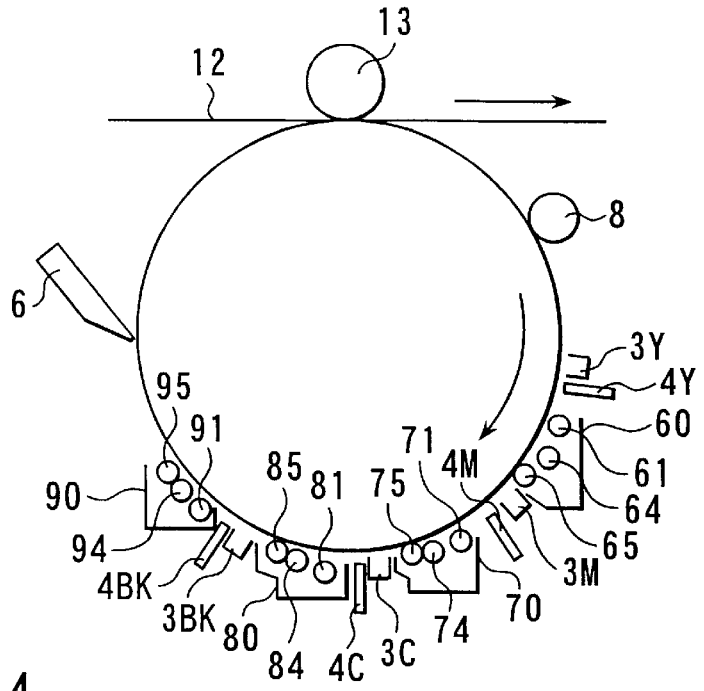
FIG. 14 is a schematic structural diagram showing a wet image forming apparatus according to a second embodiment of the present invention.

FIG. 14 is a schematic diagram for explaining a full-color image forming apparatus in which four developing devices are arranged along the periphery of the photosensitive body 1, each developing device having a structure substantially the same as that of the wet developing device explained with reference to FIG. 1.

The structure the same as or similar to that shown in FIG. 1 is identified by the same reference numeral (or the same last digit) as that used in FIG. 1, and detailed descriptions thereof are omitted. Four elements provided for the respective colors are accompanied by the letters Y, M, C and BK for the purpose of distinction.

In the color image forming apparatus shown in FIG. 14, first to fourth developing devices 60, 70, 80 and 90 are arranged around the photosensitive body 1 in this order along the direction of rotation of the photosensitive body 1. The first to third developing devices 60, 70 and 80 hold toner liquids respectively comprising pigments of Y (yellow), M (magenta) and C (cyan), which are the three color components of subtractive primaries, for forming color images of the corresponding colors. The fourth developing device 90 holds a BK (black) toner liquid for emphasizing black and providing a monochrome black image.

First to fourth charging devices 3Y, 3M, 3C and 3BK for providing the photosensitive body with predetermined potentials are located on the upstream side of the respective developing devices 60, 70, 80 and 90 along the direction of rotation of the photosensitive body 1. First to fourth exposure devices 4Y, 4M, 4C and 4BK are located respectively between the charging devices and the developing devices of the corresponding colors. In the case where each exposure device is, for example, a laser beam exposure device, the exposure device may have any shape and arrangement, so far as the final output laser beam can expose image information between the charging device and the developing device. Another type of known exposure device, for example, an LED, may be used.

The developing-devices 60, 70, 80 and 90 respectively comprise developing rollers 61, 71, 81 and 91 which face the periphery of the photosensitive body 1 with a distance of 40 to 300 $\mu$m therebetween. They also comprise non-contact squeeze rollers 64, 74, 84 and 94 and contact squeeze rollers 65, 75, 85 and 95.

In the image forming apparatus as described above, the photosensitive body 1 is charged by the charging device 3Y at a predetermined potential, and a latent image corresponding to yellow (Y) is formed by the exposure device 4Y. The Y latent image is developed by the Y toner liquid supplied from the developing device 60 and a Y toner image is formed on the photosensitive body 1. At this time, the surplus of the toner liquid supplied to the Y latent image on the photosensitive body 1 by the developing roller 61 of the developing device 60 is scraped off from the photosensitive body 1 by the non-contact squeeze roller 64 which faces the photosensitive body with a distance of 20 to 100 $\mu$m (smaller than the gap at the development position). The squeeze roller 64 is rotated against the photosensitive body at a peripheral speed 1 to 3 times that of the photosensitive body. The solvent remaining on the surface of the photosensitive body 1 is removed by the contact squeeze roller 65.

Subsequently, the photosensitive body 1, on which the Y toner image has been formed, is charged by the charging device 3M at a predetermined potential, and a latent image corresponding to magenta (M) is formed by the exposure device 4M. The M latent image is developed by the M toner liquid supplied from the developing device 70 and an M toner image is formed on the Y toner image or a predetermined position of the photosensitive body 1. At this time, the surplus of the toner liquid supplied to the M latent image on the photosensitive body 1 by the developing roller 71 of the developing device 70 is scraped off from the photosensitive body 1 by the non-contact squeeze roller 74. The solvent remaining on the surface of the photosensitive body 1 is removed by the contact squeeze roller 75.

Then, the photosensitive body 1, on which the Y and M toner images have been formed, is charged by the charging device 3C at a predetermined potential, and a latent image corresponding to cyan (C) is formed by the exposure device 4C. The C latent image is developed by the C toner liquid supplied from the developing device 80 and a C toner image is formed on the Y and M toner images or a predetermined position of the photosensitive body 1. At this time, the surplus of the toner liquid supplied to the C latent image on the photosensitive body 1 by the developing roller 81 of the developing device 80 is scraped off from the photosensitive body 1 by the non-contact squeeze roller 84. The solvent remaining on the surface of the photosensitive body 1 is removed by the contact squeeze roller 85.

Thereafter, the photosensitive body 1, on which the Y, M and C toner images have been formed, is charged by the charging device 3BK at a predetermined potential, and a latent image corresponding to black (BK) is formed by the exposure device 4BK. The BK latent image is developed by the BK toner liquid supplied from the developing device 90 and a BK toner image is formed on the Y, M and C toner images or a predetermined position of the photosensitive body 1. At this time, the surplus of the toner liquid supplied to the BK latent image on the photosensitive body 1 by the developing roller 91 of the developing device 90 is scraped off from the photosensitive body 1 by the non-contact squeeze roller 94. The solvent remaining on the surface of the photosensitive body 1 is removed by the contact squeeze roller 95.

The solvent components of the toners of the four colors, deposited on the photosensitive body 1 as described above, are removed by the blower 6. Thereafter, the toner image is transferred to a paper sheet 12 conveyed between an output transfer pressurizing roller 13 and the photosensitive body 1. The order of arrangement of the developing devices for the four colors is not limited to the above.

The toner (image) transferred to the transfer material 12 is fixed thereto by a fixing device (not shown) by heating the toner and the transfer material to melt the toner, and applying a pressure thereto. Then, the transfer material 12 is carried to a predetermined position.

As described above, with a full-color image forming apparatus in which four developing devices holding the toner liquids of the four color are arranged along the periphery of the photosensitive body 1, when the Y, M, C and BK images are consecutively superposed on the photosensitive body 1 and transferred at a time to the paper sheet 12, the developer toner in the lower layer is not removed by the developing device of the next color and the four color images are successfully transferred.

Figure 15:
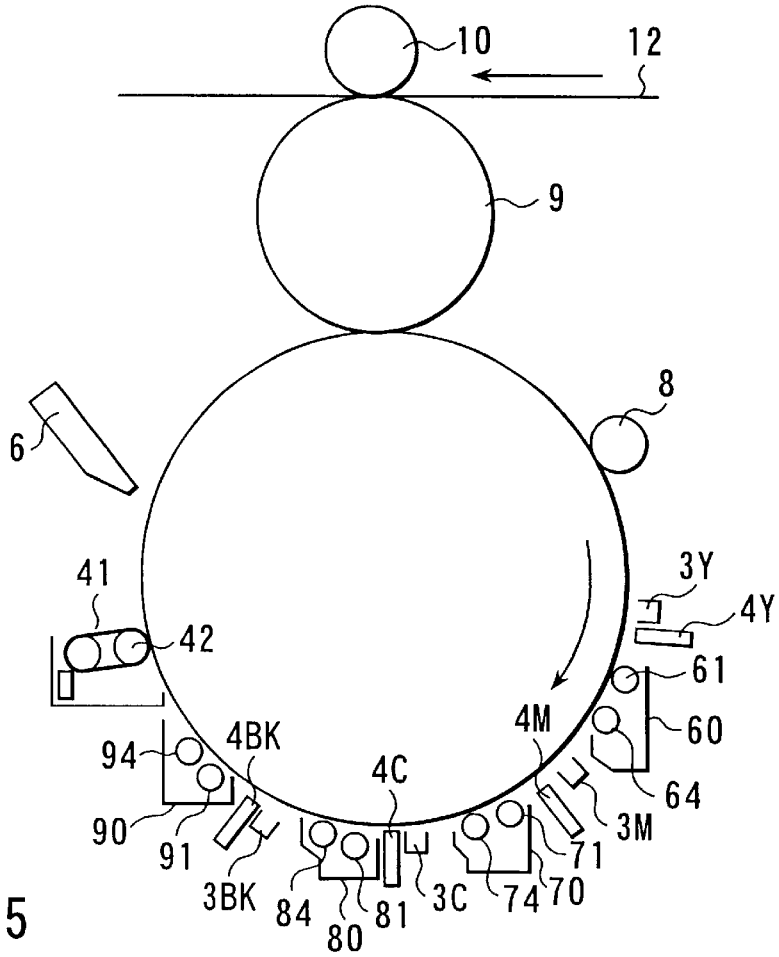
FIG. 15 is a schematic structural diagram showing a wet image forming apparatus according to a third embodiment of the present invention.

FIG. 15 is a schematic diagram for explaining a full-color image forming apparatus in which four developing devices are arranged along the periphery of the photosensitive body 1, each developing device having a structure substantially the same as that of the wet developing device explained with reference to FIG. 1. The structure the same as or similar to that shown in FIG. 1 is identified by the same reference numeral (or the same last digit) as that used in FIG. 1, and detailed descriptions thereof are omitted. Four elements provided for the respective colors are accompanied by the letters Y, M, C and BK for the purpose of distinction.

In the image forming apparatus shown in FIG. 15, the concept of intermediate transfer as in the case of the image forming apparatus shown in FIG. 1 is added to the image forming apparatus shown in FIG. 14.

In the color image forming apparatus shown in FIG. 15, first to fourth developing devices 60, 70, 80 and 90 are arranged around the photosensitive body 1 in this order along the direction of rotation of the photosensitive body 1. The first to third developing devices 60, 70 and 80 hold toner liquids respectively comprising pigments of Y (yellow), M (magenta) and C (cyan), which are the three color components of subtractive primaries for forming color images of the corresponding colors. The fourth developing device 90 holds a BK (black) toner liquid for emphasizing black and providing a monochrome black image. First to fourth charging devices 3Y, 3M, 3C and 3BK, comprising known chargers for providing the photosensitive body with predetermined potentials, are located on the upstream side of the respective developing devices 60, 70, 80 and 90 along the direction of rotation of the photosensitive body 1. First to fourth exposure devices 4Y, 4M, 4C and 4BK are located respectively between the charging devices and the developing devices of the corresponding colors. In the case where each exposure device is, for example, a laser beam exposure device, the exposure device may have any shape and arrangement, so far as the final output laser beam can expose image information between the charging device and the developing device.

The developing devices 60, 70, 80 and 90 respectively comprise developing rollers 61, 71, 81 and 91 which face the periphery of the photosensitive body 1 with a distance of 40 to 300 $\mu$m therebetween. They also comprise non-contact 64, 74, 84 and 94 and contact squeeze rollers 65, 75, 85 and 95.

A contact squeeze belt 41 similar to that shown in FIG. 10 is provided on the downstream side of the developing device 90 in the direction of rotation of the photosensitive body. The contact squeeze belt 41 is a seamless film belt made of PET, polycarbonate, polyimide, fluorine-based resin (PVDF, ETFE, etc.), etc. The contact squeeze belt 41 may have conductivity, and a bias voltage may be applied thereto to prevent the toner from adhering.

A backup roller 42 for pressing the contact squeeze belt 41 against the photosensitive body 1 is preferably an elastic roller to provide a contact nip with the photosensitive body 1. The contact squeeze belt 41 may have on its inner surface an elastic layer, and may be brought into contact with the photosensitive body by means of a metal backup roller.

Toner liquids of the four colors, similar to that as described with reference to FIG. 14, are used in the respective developing devices 60, 70, 80 and 90.

In the image forming apparatus as described above, the photosensitive body 1 is charged by the charging device 3Y at a predetermined potential, and a latent image corresponding to yellow (Y) is formed by the exposure device 4Y. The Y latent image is developed by the Y toner liquid supplied from the developing device 60 and a Y toner image is formed on the photosensitive body 1. At this time, the surplus of the toner liquid supplied to the Y latent image on the photosensitive body 1 by the developing roller 61 of the developing device 60 is scraped off from the photosensitive body 1 by a first squeeze roller 64.

Subsequently, the photosensitive body 1, on which the Y toner image has been formed, is charged by the charging device 3M at a predetermined potential, and a latent image corresponding to magenta (M) is formed by the exposure device 4M. The M latent image is developed by the M toner liquid supplied from the developing device 70 and an M toner image is formed on the Y toner image or a predetermined position of the photosensitive body 1. At this time, the surplus of the toner liquid supplied to the M latent image on the photosensitive body 1 by the developing roller 71 of the developing device 70 is scraped off from the photosensitive body 1 by a first squeeze roller 74.

Then, the photosensitive body 1, on which the Y and M toner images have been formed, is charged by the charging device 3C at a predetermined potential, and a latent image corresponding to cyan (C) is formed by the exposure device 4C. The C latent image is developed by the C toner liquid supplied from the developing device 80 and a C toner image is formed on the Y and M toner images or a predetermined position of the photosensitive body 1. At this time, the surplus of the toner liquid supplied to the C latent image on the photosensitive body 1 by the developing roller 81 of the developing device 80 is scraped off from the photosensitive body 1 by a first squeeze roller 84.

Thereafter, the photosensitive body 1, on which the Y, M and C toner images have been formed, is charged by the charging device 3BK at a predetermined potential, and a latent image corresponding to black (BK) is formed by the exposure device 4BK. The BK latent image is developed by the BK toner liquid supplied from the developing device 90 and a BK toner image is formed on the Y, M and C toner images or a predetermined position of the photosensitive body 1. At this time, the surplus of the toner liquid supplied to the BK latent image on the photosensitive body 1 by the developing roller 91 of the developing device 90 is scraped off from the photosensitive body 1 by a first squeeze roller 94.

Then, the solvent remaining on the surface of the photosensitive body 1 is removed by rotation of the contact squeeze belt 41.

The solvent components of the toners of the four colors, deposited on the photosensitive body 1 as described above, are removed by the blower 6. Thereafter, the toner image is conveyed to a transfer region to which an intermediate transfer body 9 faces. The toner (image) conveyed to the transfer region is transferred to the surface of the intermediate transfer body 9 by pressure between the intermediate transfer body 9 and the photosensitive body 1.

The toner image transferred to the intermediate transfer body 9 is transferred to a paper sheet 12 supplied at a predetermined timing from a cassette (not shown) to an outputting transfer region between the backup roller 10 and a predetermined position of the periphery of the intermediate transfer body.

The paper sheet 12 to which the toner (image) has been transferred is conveyed toward a fixing device (not shown), in which the toner is transferred to the paper sheet 12 by pressure and heat.

As described above, with a full-color image forming apparatus in which four developing devices holding the toner liquids of the four color are arranged along the periphery of the photosensitive body 1, when the Y, M, C and BK images are consecutively superposed on the photosensitive body 1 and transferred at a time to the paper sheet 12, the developer toner in the lower layer is not removed by the developing device of the next color and the four color images are successfully transferred.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

image forming means for forming a latent image on an image carrier body which is rotating;

developing means, containing liquid developer in which developer particles are dispersed in a solvent, for supplying the liquid developer to the latent image on the image carrier body and forming a developer image;

removing means, which rotates in contact with the image carrier body, for removing a surplus of the liquid developer remaining on the image carrier body after development; and transfer means for transferring the developer image to a transfer material after the surplus of the liquid developer is removed by the removing means, the removing means having a surface configuration which allows contact with the developer image on the image carrier body with a uniform contact pressure in a contact portion where the removing means contacts to the image carrier body, wherein the removing means has concavities and convexities on its surface, a period of the concavities and convexities is greater than a diameter of a minimum unit portion or a width of a thinnest line of the developer image formed on the image carrier body by the image forming means.

2. An image forming apparatus according to claim 1, wherein the period of the concavities and convexities is 50 to 200 $\mu$m and the diameter of the minimum unit portion or the width of the thinnest line of the developer image 30 $\mu$m.

3. An image forming apparatus according to claim 1, wherein the removing means is a roller member formed by molding conductive resin material.

4. An image forming apparatus according to claim 3, wherein the resin material is polyurethane resin.

5. An image forming apparatus according to claim 1, wherein the removing means is in contact with the image carrier body and rotated in a same direction and at a same speed as the image carrier body is rotated.

6. An image forming apparatus comprising:

image forming means for forming a latent image on an image carrier body which is rotating;

developing means, containing liquid developer in which developer particles are dispersed in a solvent, for supplying the liquid developer to the latent image on the image carrier body and forming a developer image;

removing means, which rotates in contact with the image carrier body, for removing a surplus of the liquid developer remaining on the image carrier body after development; and transfer means for transferring the developer image to a transfer material after the surplus of the liquid developer is removed by the removing means, the removing means having a surface configuration which allows contact with the developer image on the image carrier body with a uniform contact pressure in a contact portion where the removing means contacts to the image carrier body, wherein the removing means has concavities and convexities continuously formed in a direction of rotation on its surface, and a period of the concavities and convexities is greater than a width of the contact portion where the removing means contacts to the image carrier body.

7. An image forming apparatus according to claim 6, wherein the period of the concavities and convexities is about 600 $\mu$m and the width of the contact portion where the removing means contacts to the image carrier body is 0.5 mm.

8. An image forming apparatus comprising:

image forming means for forming a latent image on an image carrier body which is rotating;

developing means, containing liquid developer in which developer particles are dispersed in a solvent, for supplying the liquid developer to the latent image on the image carrier body and forming a developer image;

removing means, which rotates in contact with the image carrier body, for removing a surplus of the liquid developer remaining on the image carrier body after development; and transfer means for transferring the developer image to a transfer material after the surplus of the liquid developer is removed by the removing means, the removing means having surface roughness smaller than a thickness of a layer of the developer image formed on the image carrier body, wherein the removing means is a belt member having a thickness of 200 $\mu$m.

9. An image forming apparatus according to claim 8, wherein the belt member is formed by molding conductive polyurethane resin.

10. An image forming apparatus according to claim 8, wherein the belt member is in contact with the image carrier body and rotated in a same direction and at a same speed as the image carrier body is rotated.

* * * * *